United States Patent [19]

Ginsberg et al.

[11] 4,262,907

[45] Apr. 21, 1981

[54] GAME HAVING A GAME BOARD AND COMPONENTS TO BE USED THEREWITH

[75] Inventors: Allen Ginsberg, New York; Martin F. Huss, Brooklyn, both of N.Y.; Joseph Lynn, Burlington, N.J.

[73] Assignee: Pentagames, Inc., New York, N.Y.

[21] Appl. No.: 881,117

[22] Filed: Feb. 24, 1978

[51] Int. Cl.[3] ..... A63F 3/00

[52] U.S. Cl. ..... 273/249; 273/288; 273/243

[58] Field of Search ..... 273/249, 258, 261, 287, 273/294, 242, 261

[56] References Cited

U.S. PATENT DOCUMENTS

| | | | |
|---|---|---|---|
| D. 34,678 | 6/1901 | Wegmann | 273/261 |
| D. 153,206 | 3/1949 | Carroll | 273/242 |
| 378,931 | 3/1888 | Hyde | 273/261 |
| 3,104,106 | 9/1963 | Kenny | 273/249 |
| 3,843,130 | 10/1974 | Whitney | 273/261 |
| 4,120,503 | 10/1978 | Macrory | 273/248 |

FOREIGN PATENT DOCUMENTS

| | | | |
|---|---|---|---|
| 730157 | of 1932 | France | 273/261 |
| 924370 | 4/1947 | France | 273/242 |
| 1169545 | of 1958 | France | 273/294 |
| 5073 | of 1901 | United Kingdom | 273/249 |
| 1196482 | of 1970 | United Kingdom | 273/254 |

*Primary Examiner*—Richard C. Pinkham
*Assistant Examiner*—R. Carl Moy
*Attorney, Agent, or Firm*—Steinberg & Raskin

[57] ABSTRACT

A game is provided with a game board having a central space and an inner ring of spaces surrounding the central space. The game board has a plurality of wavy paths each defined by a series of spaces with these wavy paths extending outwardly from the inner ring of spaces to an outer peripheral region of the game board. The wavy paths defined by the series of spaces contact each other to provide for continuous paths extending from the outer peripheral region of the game board inwardly toward the inner ring of spaces as well as circumferentially around the latter along circumferential wavy paths while the wavy paths define between themselves barrier spaces separating the paths from each other. By way of a chance device it is possible for the different players to move player-identifying game pieces along the various spaces progressing along the wavy paths in various directions. Different spaces may have different identifying indicia with which certain cards are correlated by the same identifying indicia so that according to predetermined rules certain groups of cards may be used, for example, to give players the right to occupy the inner ring of spaces.

4 Claims, 11 Drawing Figures

START
START
18
18
18
18
18
24
16
16
12
14

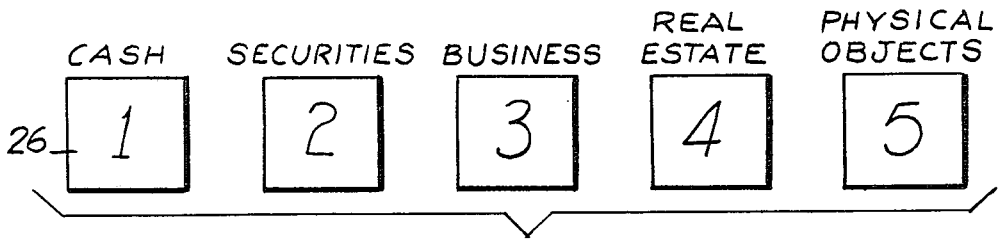
FIG. 2
FIG. 3
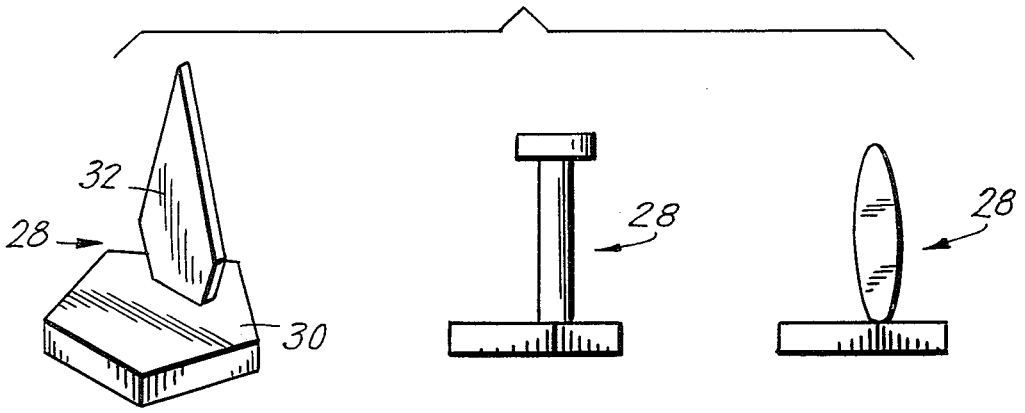
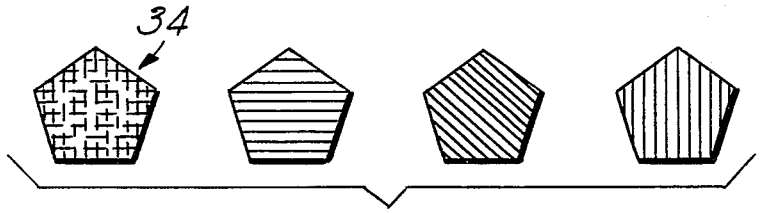
FIG. 4
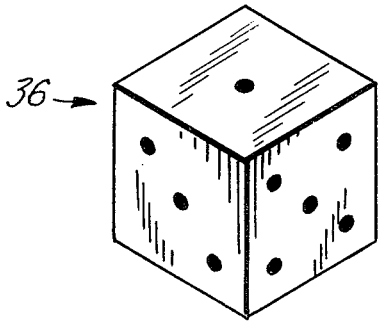
FIG. 5

FIG. 7A

YOUR LAWYER HANDLING THE WILL IS DISBARRED FOR INCOME TAX EVASION. (WEAKENS PROOF OF I.D.)

ACTION: YOU MAY NOT TRY TO CLAIM AN INHERITANCE SPACE ON YOUR NEXT TURN.

50

YOUR LIBRARY CARD IS VOIDED BY THE LIBRARY, BECAUSE YOU HAVE NOT PAID YOUR OVERDUE BOOK CHARGES. (WEAKENS PROOF OF I.D.)

ACTION: MOVE OFF THE BOARD TO ANY START LOCATION.

52

FIG. 7B

YOUR WATCH HAS BEEN TRACED TO A LITTLE OLD SWISS WATCH-MAKER WHO USED TO MAKE CUSTOM WATCHES FOR THE TYCOON. (STRENGTHENS PROOF OF I.D.)

ACTION: YOU MAY PASS FREELY THROUGH ANY PENALTY OR BLOCK ON YOUR NEXT TURN.

54

THE TYCOON'S GARDENER HAS UNEARTHED A LOST DIARY WHICH HAS REFERENCES TO YOU IN IT, WHILE FERTILIZING THE BROCCOLI PLANTS.

(STRENGTHENS PROOF OF I.D.)

ACTION: TAKE ANOTHER TURN.

56

FIG. 8

SET CARD
4 REAL-ESTATE 4

58

SET CARD
1 CASH 1

60

GAME HAVING A GAME BOARD AND COMPONENTS TO BE USED THEREWITH

BACKGROUND OF THE INVENTION

The present invention relates to games.

In particular, the present invention relates to that type of game which includes a game board and various game components such as cards, game pieces, chance devices, and the like.

At the present time, there are many known types of games which include game boards of different patterns and game pieces, cards, chance devices, and the like. However, conventional games fail to hold the interest of the players for relatively long intervals. Thus, conventional games suffer from the drawback of relying primarily upon one feature or another for creating the interest in the game. Thus, for example, certain games rely primarily on chance in order to determine the progress of the game. Other games rely primarily upon skill of the players, particularly intellectual skill, according to which a player may rely on word knowledge, strategy of moving game pieces, and the like, in order to provide competition between the players for example for possession of certain designated parts of a game board. However, some known games have extremely complex rules and are exceedingly elaborate, rendering the games far too difficult for most players, whereas other games are much too simple for most players creating a loss of interest in the games after a short interval.

SUMMARY OF THE INVENTION

It is accordingly a primary object of the present invention to provide a game which will on the one hand not be too simple for most players so as to be able to sustain the interest of a number of players over a considerable period of time, while on the other hand being simple enough to maintain the interest of a relatively large number of players over a considerable period of time.

In particular, it is an object of the present invention to provide a game which will involve elements both of chance and of skill, while at the same time creating competition between players for possession of certain portions of a game board.

In addition, it is an object of the present invention to provide a game which is exceedingly varied and colorful both with respect to the appearance of the game board and the components used therewith as well as with respect to the manner in which the game is played.

In addition, it is an object of the present invention to provide a game of the above general type which lends itself to adaptation to certain types of competition which are encountered in everyday life.

In particular, it is an object of the present invention to provide a game of the above general type which can be played in a manner making it possible for various players to compete for possession of items representing property, currency, or the like, of considerable value.

Also, it is an object of the present invention to provide a game of the above general type which is of sufficient flexibility to permit the game to be played by two or more players.

Furthermore, it is an object of the present invention to provide a game according to which game pieces are not required to be moved at all times only in one particular direction but rather permitting the game pieces to be moved in a number of different directions in order to give players certain advantages.

Also, it is an object of the present invention to provide a game which will provide players not only with the capability of progressing by way of chance but also with certain strategic capabilities permitting players to occupy certain positions in a game board which will block movement of players through certain locations occupied by other players so that with the game of the invention it is possible for players to build up, as the game progresses, certain advantageous competitive postions.

In addition, it is a particular object of the present invention to provide a game board which while being exceedingly compact and of relatively small size nevertheless is capable of accommodating a relatively large number of players while affording the players an extremely wide variety of possible movements in a relatively small limited space.

According to the invention the game board has a central space of a given geometrical configuration surrounded by an inner ring of spaces also of given geometrical configuration. Outwardly beyond the inner ring of spaces the game board has a relatively large number of wavy paths each formed by a series of contiguous spaces of given geometric configuration, and these wavy paths contact each other so as to provide the possibility of transferring a game piece from a space of one wavy path to the space of the next wavy path in a direction extending circumferentially around the inner ring of spaces. These wavy paths define between themselves gaps in the game board which form barriers across which the players are not permitted to move their game pieces. The various spaces which form the wavy paths carry indicia which distinguish groups of spaces from each other, and various cards have corresponding indicia which become identified with the various groups of spaces so that by use of a chance means it is possible for a player to situate a game piece with which he is identified on a certain space having a given identification correlated with a given card which when possessed by a player gives the player a certain advantage. These cards may be correlated in such a way, according to particular rules, that when a given set of cards come into the possession of one player, this player will have the opportunity to occupy one of the spaces at the inner central ring of spaces. At the same time, by situating player-identifying pieces on various spaces it is possible for one player to block the movement of another player to render it more difficult for certain players to reach certain spaces toward which players could otherwise move when possessing certain cards. In addition, certain of the spaces carry indicia designating them as action spaces correlated with certain action cards which further amplify movements permitted to certain players. It is thus possible in this way to provide a game of a simple construction which nevertheless is extremely varied, having a wide variety of chance, skill, and competitive as well as strategic characteristics which while in some cases permitting the game to be played by a number of players in an extremely short time will at the same time in other cases provide a game which could last among several players for several hours.

BRIEF DESCRIPTION OF DRAWINGS

The invention is illustrated by way of example in the accompanying drawings which form part of this application and in which:

FIG. 2 illustrates five inheritance markers adapted to be used at an inner ring of spaces;

FIG. 3 illustrates in perspective examples of various personal markers to be respectively used by different players;

FIG. 4 illustrates examples of various identification markers to be used by different players;

FIG. 5 illustrates an example of a chance means which may be used with the invention;

FIGS. 7A and 7B illustrate different types of action cards which are to be used with the game board; and FIG. 8 shows examples of set cards which are to be used in order to represent certain groups of the cards of FIGS. 6A and 6B.

DESCRIPTION OF PREFERRED EMBODIMENTS

Figure 1A:
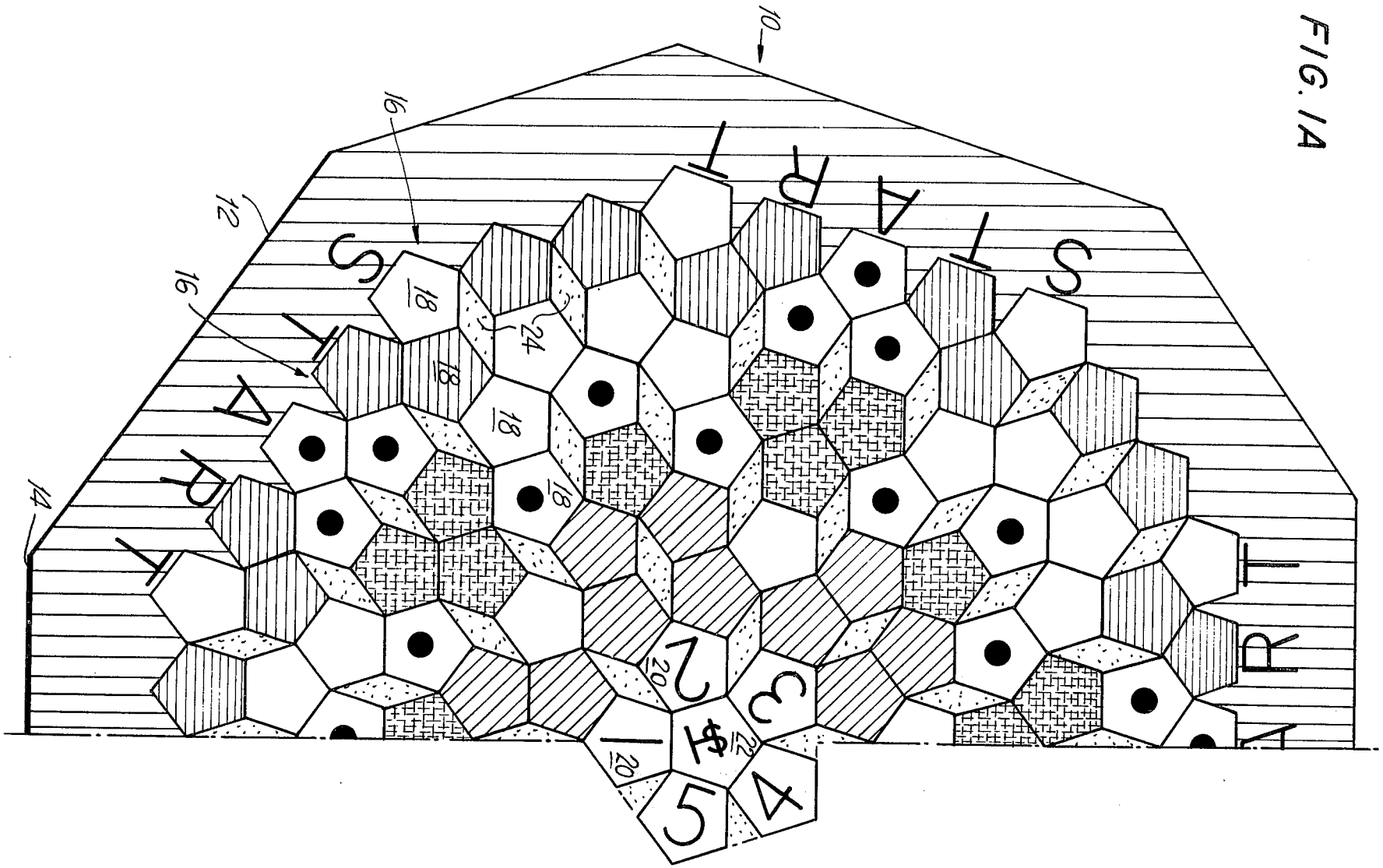
FIGS. 1A and 1B form a continuation of each other and illustrate one possible embodiment of a game board according to the present invention.
Figure 1B:
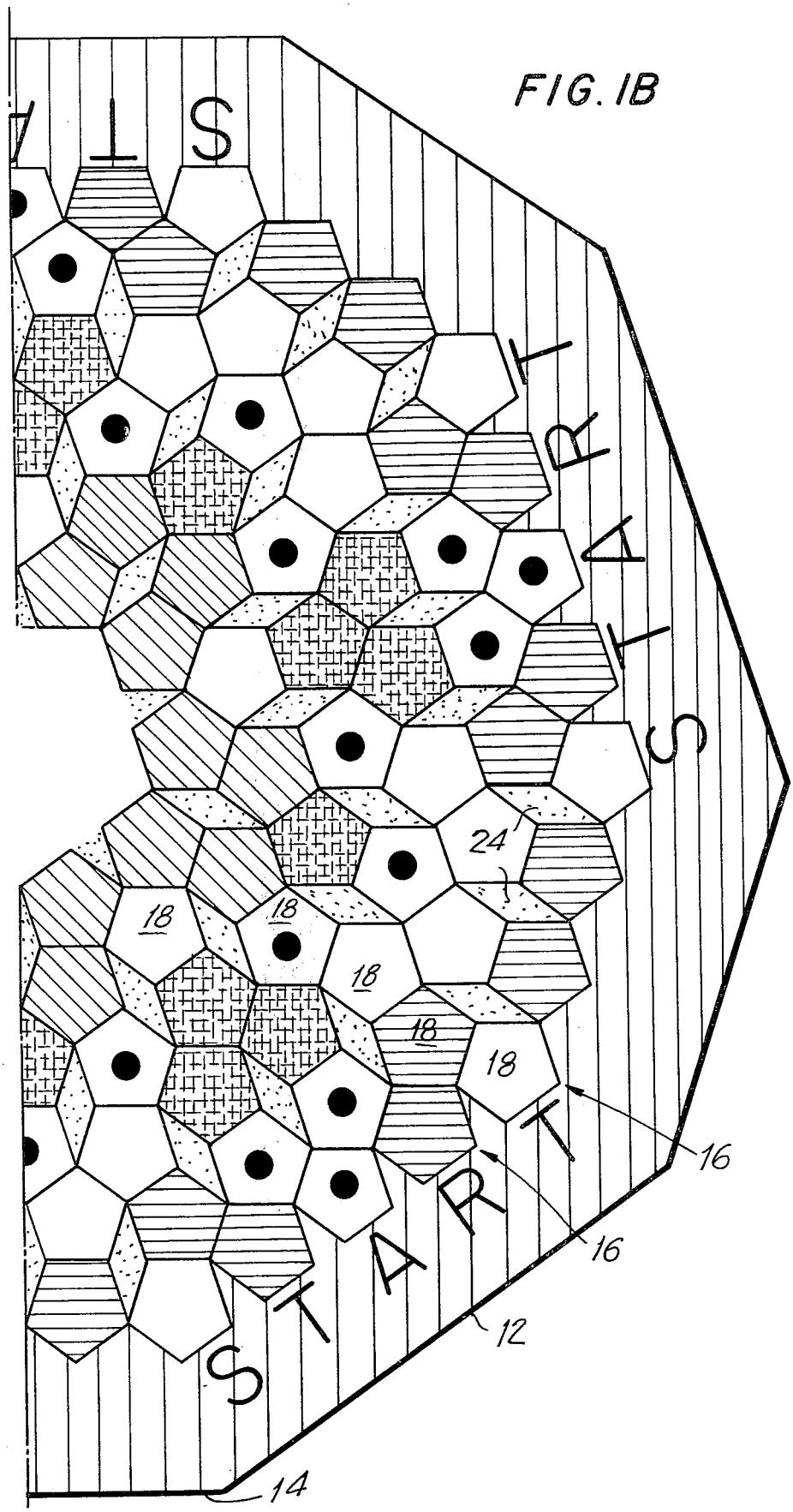

Referring now to the drawings, FIGS. 1A and 1B together illustrate one possible configuration of a game board according to the present invention. It will be seen that the game board 10 is of a polygonal configuration having five straight outer side edges 12 which are in turn respectively separated by straight edges 14, so that the illustrated game board 10 has the configuration of a decagon. In this decagon the straight edges 12 are longer than the straight edges 14. The game board 10 may be made of any suitable sheet material such as a relatively stiff thick paper, or cardboard, or even a plastic sheet material having a thickness on the order of $\frac{1}{8}$ inch, for example.

The bottom surface of the game board is unmarked and is adapted to rest against the surface of a table or the like so that the upper surface of the game board which is visible in FIGS. 1A and 1B will be visible to and available to the players of the game who arrange themselves around the game board.

Just inside of the straight edge regions 12 the game board carries the word "START", as illustrated, so that with the game board 10 it is possible for a maximum of five players to utilize the game board at one time with each player being situated at the region of one of the side edges 12 where the word "START" is situated as illustrated. The several letters of the word "START" are respectively situated adjacent outer end regions of a plurality of wavy paths 16, each made up of a series of contacting spaces 18 which have a given geometric configuration. Thus it will be seen that in the illustrated example each wavy path 16 is made up of a series of regular pentagonal spaces 18. The series of spaces 18 of each wavy path 16 contact each other with each pair of successive spaces 18 having a common straight side as illustrated.

It will be seen from FIGS. 1A and 1B that the several wavy paths 16, each made up of a series of contacting spaces 18, progress substantially radially inwardly from the outer peripheral region of the game board 10 toward an inner central region thereof where the several paths 16 terminate at an inner ring of spaces 20. This inner ring of spaces 20 are numbered 1–5, respectively, and each space 20 is also of the configuration of a regular pentagon of the same size as the pentagonal spaces 18. It will be seen that the two outer side edges of each pentagonal space 20 are in common with a pair of pentagonal spaces 18 at the inner ends of a pair of wavy paths, while the inner straight edges of each space 20 is in common with an edge of an innermost central pentagonal space 22. This central innermost space 22 in the illustrated example carries a decorative indication made up of the letters SH indicating the particular game used to illustrate the invention, this game being known as SOLE HEIR.

It will be noted that because the several spaces 18, 20, and 22 have the illustrated pentagonal configuration, these spaces will naturally assume the wavy configuration for the paths 16 as a result of the common sides of adjoining spaces so that with this particular feature of the invention it is possible to compactly arrange a large number of spaces along wavy paths in a relatively small total space. Moreover, it will be noted that the several wavy paths 16 of spaces 18 contact each other at predetermined locations. Thus, while these paths define between themselves barrier gaps or spaces 24 which are of a substantially diamond-shaped configuration and which may be considered as barrier gaps or spaces across which game pieces are not to be moved, these spaces 18, where they do not define the barriers 24, contact each other among the several paths 16 so as to define in this way continuous circumferential paths enabling, as described below, game pieces to be moved not only substantially radially along the paths 16 but also circumferentially around the space 22 without moving a game piece across any of the barrier spaces 24.

The pluarlity of spaces 18 which are situated outwardly beyond the inner ring of spaces 20 are divided in the illustrated example into three groups of annular spaces circumferentially surrounding the inner ring of spaces 20. Each annular group of spaces 18 includes two circular rings of spaces 18. Thus the inner two rings of circular spaces 18 situated nearest to the inner ring of spaces 20 may be colored green, for example, so as to be identified as the spaces of this particular inner group, although it will be noted that in the second circular ring of spaces 18, counting from the inner row of spaces 20 some of the spaces 18 are blank for a purpose referred to below. Thus except for these blank spaces 18 the remainder of the inner two circular rings of spaces 18 are uniformly colored green.

The next two circular rings of spaces 18 form an intermediate group many of which are colored yellow, for example, so as to distinguish them from the inner group, while the remaining spaces of this intermediate group are clear or white, except that some of these spaces 18 which otherwise would be clear carry a central black dot for a purpose referred to below.

Finally, the intermediate group of spaces 18 is surrounded by an outer group made up also of two circular rings and spaces 18, and many of these spaces of the outer group are colored blue, for example, so as to distinguish these spaces from the spaces of the intermediate and inner groups. Except for those spaces of the outer group which are colored blue, it will be seen that the remaining spaces are clear with some of these clear spaces 18 of the outer group also having central black dots as illustrated.

The several wavy paths 16 terminate in outer end regions which are adjacent the outer peripheral region of the game board 10, of it will be seen that five of the outer end regions of the paths 16 are situated substantially in alignment with the longer outer edges 12 of the game board. These five outer end regions of the paths 16 which are respectively in alignment with each straight edge portion 12 have situated next to the same the letters START, as illustrated, so as to designate for the players the starting location, the illustrated game board being capable of accommodating a maximum of five players. Of course less than five players can also play the game, and in this case the players would normally situated themselves as far apart as possible around the game board so that, for example, if two players only were to use the game of the invention they would situate themselves at substantially opposite parts of the game board 10.

The above-described game board of the invention is utilized in combination with additional game components which include various types of cards, identification game pieces, chance devices, and the like. In the particular example described below, the several additional parts of the game together with the above-described game board form a game which is based on a legal contest to determine the SOLE HEIR to a fortune, the legal contest involving a contested will of an extremely wealthy tycoon, all of whose property is to go to the SOLE HEIR who proves himself indeed to be the SOLE HEIR as the game progresses, so as to receive the entire inheritance.

FIG. 2 illustrates five inheritance markers 26 which initially are respectively placed on the correspondingly numbered five spaces 20 of the inner ring of spaces. Thus it will be seen that these five inheritance markers 26 are respectively numbered 1–5 and respectively represent cash, securities, business, real estate and physical objects. For this purpose in addition to the numerical designations the several small cards 26 which form the inheritance markers may have on them certain designations indicating their significance. Thus the card 26 which represents cash may have a picture of currency thereon while the card which represents securities may have a picture of a stock certificate thereon, and so on.

FIG. 3 illustrates examples of personal markers 28 which are to be used by the several players, three such markers being illustrated, although of course there will be five in the particular game which utilizes the game board of FIGS. 1A and 1B. All of these personal markers 28 have a pentagonal base 30 having fixed to its upper surface an elongated upright member 32. These members 32 may have different configurations such as that of a diamond, an ellipse, a T, etc., although if desired all of the upright members 32 and the bases 30 may have an identical configuration but be differently colored so as to distinguish them from each other. Each player will of course utilize one of these personal markers 28 for movement along the game board in a manner described below.

FIG. 4 illustrates examples of identification markers 34. These identification markers 34 are in the form of relatively small cards of pentagonal configuration so as to be capable of convenient placement on any of the pentagonal spaces of the game board. These different identification markers 34 may also be differently colored so as to be identified through this color type of indicia with different players. There may be fifty, for example, identification markers for each player, with all of these identification markers for a given player having the same color. Thus although only four identification markers are shown in FIG. 4, it will be understood that five groups will be provided, each group including fifty markers of the same color, these colors being for example, black, blue, grey, red, and green. Thus each player will have for his own personal use approximately fifty identification markers of a given color.

The game is also to be utilized with a chance means which as shown in FIG. 5 may take the form of a die 36. Of course other chance means may be utilized such as a spinner, which is to say a rotary pointer which can stop by friction in an uncontrolled manner in alignment with a given number. It is possible to provide five dice, intended to be respectively utilized by the five different players, although if desired it is also possible to provide only one die to be used in turn by the several players.

Figure 6A:
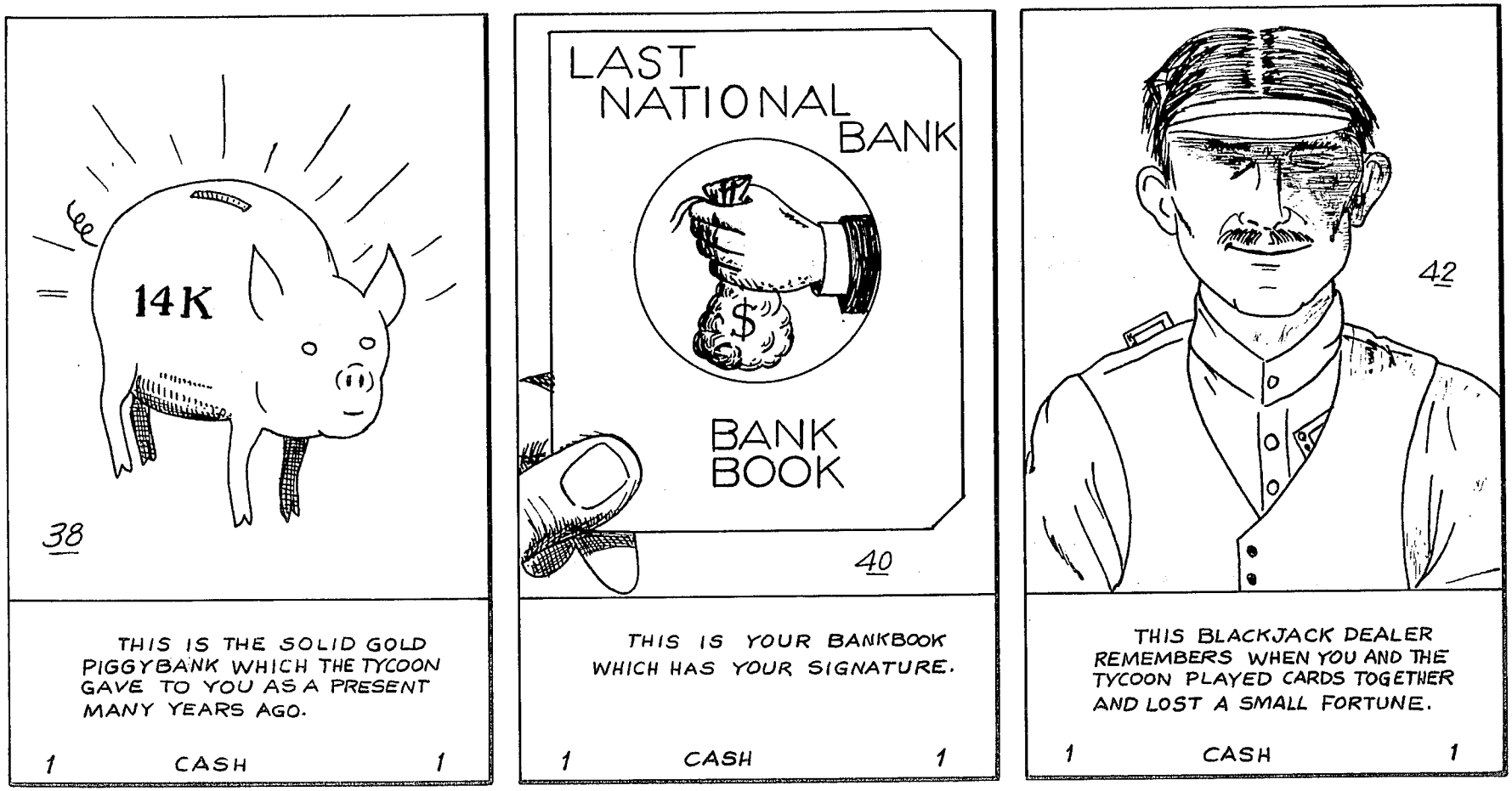
FIGS. 6A and 6B illustrate various types of cards which are used in conjunction with the game board.
Figure 6B:
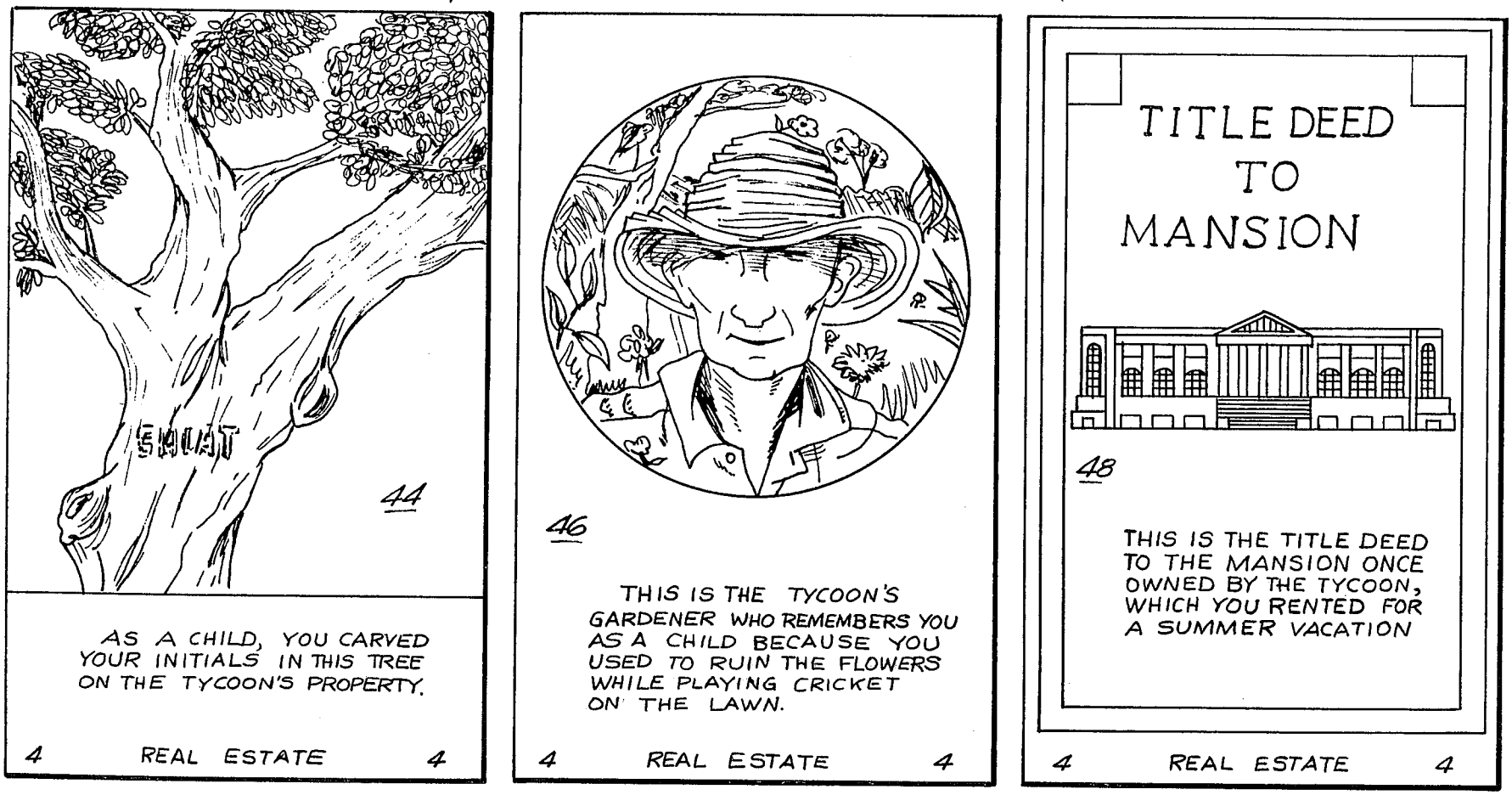

FIGS. 6A and 6B illustrate some of a plurality of identification cards of which there may be, for example, ninety, thirty of which are colored green so as to correspond to the inner group of spaces 18, thirty of which are colored yellow so as to correspond to the intermediate group of spaces 18, and thirty of which are colored blue so as to correspond to the outer group of spaces 18. These three groups of cards which respectively correspond to the above groups of spaces on the game board so as to be identified therewith are each made up of several cards belonging to the different categories 1–5 of the inner ring of spaces 20. Thus each of these groups of thirty cards each may include five cards which pertain to the space 20 bearing the number 1, this being the cash space, six cards belonging to category number 2, shown for the space 20 which bears the number 2, and this latter category being real estate, and so on. Thus it will be seen that FIG. 6A shows three different cards, 38, 40 and 42 which belong to category 1, representing cash. However, these cards are all colored differently and come from the above groups of identification cards. Thus, for example, the cards 38, 40 and 42 may respectively be colored blue, yellow and green so as to correspond in this way to the different groups of spaces 18. The card 38 represents a personal item of proof of inheritance, the card 40 represents a documentary type of proof, and the card 42 represents an eye witness type of proof.

FIG. 6B shows further possible cards 44, 46 and 48. However, it will be noted that these cards which are differently colored to correspond to the several groups of spaces 18 all belong to category 4, which represents real estate, the card 44 showing a personal item type of proof and being colored blue, for example, while the card 46 represents an eye witness type of proof and is colored green, and finally the card 48 representing a documentary type of proof and being colored yellow.

Thus, in keeping with these examples of FIGS. 6A and 6B, there are, as set forth above, in the illustrated example, thirty different cards in each group which has a single color, corresponding to one of the groups of spaces 18, with each group of a given color having five subgroups respectively corresponding to the five categories of the inner ring of spaces 20, and all of the cards being different from each other. Thus it is to be understood that FIGS. 6A and 6B show only some examples of the cards. Various different illustrations are provided on the several cards to designate proof in the form of personal items, or proof in the form of eye witnesses, or proof in the form of documentary evidence. Thus, the cards belonging to category 3 relating to business may have representations of manufacturing plants, machinery, and the like. The cards belonging to category 4 will have thereon representations of real estate, such as houses, fields, and the like. The cards belonging to category 5 will bear representations of physical objects such as jewels, or documents representing ownership of such jewels, birth certificates, and the like.

If desired, each of the above three groups of identification cards, examples of which are illustrated in FIGS. 6A and 6B, may include in addition to the above five subgroups corresponding to the several spaces 20, a fixed type of card including one or more cards which may be designated as all-purpose cards, such a card in each of the three groups being designated as belonging to any one of the five categories represented by the several spaces 20.

As has been indicated above, some of the spaces 18 are simply clear, uncolored spaces, which may be white, for example, and these spaces represent, for example, dwell spaces. In other words if a player at the end of a given turn has his personal marker 28 ending on one of these clear white spaces 18, then the marker 28 of this particular player can simply remain at this space until the next turn of the particular player.

However, as has been pointed out above, some of the clear spaces 18 have a central black dot, and these are designated as action spaces to be utilized in conjunction with action cards, examples of which are illustrated in FIGS. 7A and 7B. The game may include, for example, a deck of one hundred such action cards. Some of these action cards, examples of which are shown in FIG. 7A, will weaken the proof of identification, whereas other action cards, examples of which are shown in FIG. 7B, serve to strenghthen the proof of identification. Thus, FIG. 7A shows cards 50 and 52 which bear thereon designations of certain items and information which will weaken the proof of identification, and as a results these particular action cards indicate certain actions which are unfavorable to a given player. Thus the action card 50 indicates that because the lawyer was disbarred this particular player may not try to claim an inheritance space 20 at his next turn. The action card 52 indicates that because of the voided library card the particular player must move off the board to any START location.

On the other hand, the cards 54 and 56 shown in FIG. 7B are of advantage to a given player. Thus the card 54 gives the particular player the capability of passing through a penalty or blocked space because of the tracing of the watch as set forth. The card 56 gives the particular player another turn because the gardener found the lost diary.

Thus it will be seen that when a player lands on one of the action spaces 18, designated by the black dot in the center thereof, such a player has the opportunity to pick one of the action cards, of which there may be one hundred as set forth above, and the particular action card which is picked may be either to the player's advantage or to the player's disadvantage. Thus in this way it is possible with the game of the invention to increase the elements of chance by way of these action cards and the particular spaces 18 which cooperate therewith. The game also includes set cards examples of which are illustrated by the cards 58 and 60 of FIG. 8. Thus, there may be, for example, thirty set cards divided among the five categories 1–5 represented by the inner ring of spaces 20. Thus it will be seen that the card 58 represents one of a number of identical cards which are respectively available to each player and which represent the real estate category, while the card 60 represents one of a number of cards available respectively to the several players and representing category 1 which is cash. According to particular rules which are provided for the game, when a player accumulates identification cards belonging to each of the three groups of rings of spaces 18, with in addition the card from each group corresponding to the same category, then the player can return these cards to the stack and instead can utilize for the group one of the set cards. Thus it will be seen that FIG. 6B shows three differently colored cards respectively belonging to the three groups of spaces 18 but all belonging to the real estate category. If a player should receive these three cards then they can be returned to their respective stacks and replaced by a set card 58 which designates the category of these three cards. In the same way should a player accumulate the three cards of FIG. 6A, they can be respectively returned to the proper stacks and replaced by the card 60 which is shown in FIG. 8. In the same way additional set cards will be provided for the several categories.

With the game as described above, it is possible to play according to particular rules in a manner which will achieve from combinations of elements of chance and strategy different competitive positions between the several players which will result in an extremely interesting game which can last for a considerable amount of time while sustaining the interest of all of the players. Thus, for example, a chance means such as the die 36 of FIG. 5 can be utilized to determine the sequence in which the several players will take their turns. In order to start the game a player will place his personal marker 28 on one of the letters START at the edge 12 of the game board 10 which is adjacent the particular player. Then when a player takes his turn he will roll the die or utilize another corresponding chance means, so as to come up with a certain number which will designate the number of spaces 18 along which the player can move his personal marker 28. During the progress of the game, any player can of course move, with certain exceptions referred to below, his personal marker along a number of spaces 18 corresponding to the number determined by the chance means such as the chance means 36, the only requirement being that the personal marker 28 cannot be moved across a barrier space 24 and cannot be moved in an endless manner so as to end up at the same starting space. Otherwise it is possible for the particular player to advance his personal marker either inwardly toward the center of the board, outwardly toward the periphery of the board, or circumferentially along the board. Should the game piece 28 of a particular player end up at a clear space 18, then the personal marker 28 can remain at this space 18 until the next turn, as pointed out above. Should the personal marker 28 end up at a clear space 18 which has a central black dot, then of course the player must pick an action card, as pointed out above, and this may be to the player's advantage or disadvantage as set forth above. Should a player land at the end of his turn on one of the colored spaces of the three groups of spaces 18, then the player will place one of his identification markers 34 on this particular space indicating that this particular space has been taken over by this particular player. Thus, upon reaching one of the colored spaces 18, the player will place his identification marker 34 thereon and will then place his personal marker 28 on the marker 34 so that this personal marker 28 will be positioned in order to advance during the next turn of the particular player. Thus it is possible as the game progresses for a given player to accumulate groups of colored spaces 18, and when such spaces are occupied by the identification markers 34 of one player, these spaces 18 are not available to the other players, so that in this way certain strategic competitive positions can be built up as the game progresses. In other words a particular colored space 18 which is occupied by an identification marker of a given player represents a space 18 which is blocked with respect to possible movement of personal markers 28 of the other players.

Of course, the rules may be such that a player when moving his personal marker 28 cannot move back and forth but instead must continuously progress along a given path from one space 18 to the next space 18 without ending up at the starting location and without moving across a barrier space 24.

Of course, should a player land on one of the action spaces he will pick an action card from the top of the action deck, and will follow the indicated action of the picked action card unless the particular action indicated does not apply to the particular player, in which case this action card is simply returned to the bottom of the deck. The action cards examples of which are shown in FIGS. 7A and 7B, are always returned immediately to the bottom of the deck and will be kept face-down in a single stack.

When a player lands on one of the colored spaces 18, not only will the player occupy this space by placing his identification marker thereon, but in addition the player will pick an identification card, examples of which are shown in FIGS. 6A and 6B, from the appropriate stack. Thus if the player lands on a green space 18, the player will pick an identification card from the green stack of identification cards, and so on. Of course, it will not be to a player's advantage to accumulate too many identification cards of the same color because each player must have one identification card of each color belonging to the same category in order to replace these three cards with a set card which is required in order to have access to one of the inner ring of spaces 20 as described above. Thus each player attempts to move his personal marker 28 in a meandering fashion along the game board in such a way as to attempt to accumulate identification cards of different colors and particularly belonging to the same category so as to give the opportunity to receive a set card, examples of which are shown in FIG. 8. Thus the players compete against each other by occupying certain colored spaces 18 so as to attempt to block movements of the other players toward certain spaces 18 which they may desire to occupy in order to receive required identification cards of the type shown in FIGS. 6A and 6B.

Once a player has a set card he then has the opportunity to occupy one of the inner ring of spaces 20, corresponding to the particular category of the set card, but only if the chance means gives the player the opportunity to move his personal marker to the proper space 20. Moreover, the rules may be such that when one of the spaces 20 is occupied by a set card of one player, then the next player who can place his set card at this particular space 20 has the right to displace the player already occupying the particular space 20 from the latter space, so that in this way there is a time element in the strategy of the game so it is not necessarily to a player's advantage to move immediately into one of the spaces 20.

Moreover, if a player should occupy at one time three of the spaces 20 with his set cards, then a certain advantage may accrue such as the inability of other players to displace this particular player from one of his colored spaces 18.

Thus, by way of suitable rules it is possible to provide an exceedingly interesting game involving both elements of chance and elements of strategy. The game can be considered as ending when one player occupies all of the spaces 20 with his set cards and lands on central spaces 22 or when he has caused all of the other players to be eliminated from the game.

In this latter connection, the rules may be such that according to certain designations on action cards or according to certain moves there are various penalties which will cause a certain player to be required to remove his identification marker from a given colored space 18, and when after the game has progressed beyond a certain point a certain player has been required to remove all of said identification markers from the colored spaces 18, then this particular player may be considered as being eliminated from the game.

Thus, the game of the invention may be accompanied by any desired set of rules to be utilized with the game structure set forth above. For example while a given player can possibly move through a colored space 18 which is occupied by his own identification marker, he cannot move through such a space 18 occupied by another player's identification marker, unless of course this particular player suffers a certain penalty which may be that the player occupying the space through which another player moves has the right to remove one of the latter player's identification markers from the game board.

Thus it is possible with the relatively simple structure of the invention to provide an exceedingly interesting game involving a number of players with a given set of rules which will enable the players to utilize the structure of the invention in such a way as to achieve at low cost a highly entertaining game.

The above description and the drawings illustrate of course only examples in accordance with the invention. Various changes may be made without going beyond the invention. For example instead of providing cards with different designations thereon such as the printed matter appearing at the lower portion of FIGS. 6A and 6B, it is possible instead simply to provide numbers at the lower portions of these cards and all of the printed information may be included in a certain code which has portions thereof referred to by such numbers so that in this way instead of each card having its own indication of the significance thereof it is possible instead to refer to a code which gives the significance of each card.

Furthermore, instead of circular dots for the action spaces, it is possible to use pentagonal dots, and in much the same way instead of using the letters START it is possible to replace these letters with dots or spots of triangular configuration, for example. In much the same way at the inner ring of the game board which surrounds the central space thereof, it is possible to use letters instead of numbers. Also, of course, the actions for the action cards may vary very greatly including such actions as, for example, a visit to a lawyer. They may be referred to as visit-to-the-lawyer cards and need not be immediately returned to the bottom of the deck if so indicated on the card.

Furthermore, the pieces as shown in FIGS. 3 and 4 may vary. All of these pieces may, for example, be transparent and of the same configuration with the pieces of this latter construction having different heights for different purposes and bearing numbers, for example, so as to be identified with different players.

Moreover, each player may have a card organizer in order to maintain various cards neatly distributed in various groups.

Also, the designation SH can simply be eliminated from the central space, if desired.

In addition, instead of providing inheritance markers 26 as indicated in FIG. 2 which are different from each other, all of these markers may be the same without departing from the invention.

It is thus apparent that many variations are possible while still maintaining all of the advantages of the invention as set forth above.

What is claimed is:

1. In a game, a game board having a central space of a given geometric configuration, an inner ring of spaces each of a given geometric configuration surrounding and contacting said central space, and a plurality of movement spaces, at least some of said spaces having barrier gaps provided therebetween, said spaces and gaps being arranged to define a plurality of elongated wavy non-linear paths made up of a series of contiguous spaces of a given geometric configuration, said paths extending outwardly from said inner ring of spaces toward an outer peripheral region of the game board, said wavy paths being situated beside each other while being distributed circumferentially around said inner ring of spaces and said wavy paths being contiguous with each other at predetermined locations so that the geometric spaces which form said paths define continuous paths extending between the outer peripheral region of the game board and said inner ring of spaces as well as continuous wavy, non-circular paths circumferentially surrounding said ring of inner spaces, said gaps being located so as to preclude the formation of radially or circularly extending paths, so that according to a given set of rules game pieces may be placed on the spaces of said wavy paths to progress therealong between the outer peripheral region of the game board and said central space thereof as well as circumferentially along the circumferential wavy paths defined by a series of contiguous portions of said wavy paths wherein at least some of said game board spaces have associated therewith different indicia means for defining a plurality of different groups of spaces, each of said groups of spaces having the same indicia means associated therewith which is different from the other indicia means and said spaces comprising a group of contiguous spaces extending circumferentially around said inner ring of spaces so as to define a plurality of mutually concentric circumferentially extending groups of contiguous spaces;

a plurality of groups of cards, each of said groups of cards having indicia means corresponding to the indicia means of a respective one of said groups of spaces, whereby according to predetermined rules when a player accumulates cards whose indicia corresponds to all of said groups, such player will have access to a space of said inner ring of spaces and wherein said cards have second indicia associated therewith which identify the same as belonging to different categories which respectively correspond to the spaces of said inner ring of spaces which have indicia associated therewith corresponding to said second indicia, whereby according to predetermined rules when a player accumulates predetermined cards belonging to the same category but different groups of said spaces such a player will have access to a space of said inner ring of spaces;

a plurality of personal markers, each having distinctive indicia means associated therewith corresponding to the respective game players, respectively provided for players of the game for movement along said paths and a plurality of identification markers having indicia means associated therewith which correspond to the player identifying indicia associated with said personal markers provided for each player to be situated in spaces onto which the personal marker of a given player is moved so that as the game progresses each player will take possession of some of said spaces with the possession being indicated by the identification markers of a given player; and chance means for determining the movement of a personal marker of each player.

2. The combination of claim 1 and wherein some of said spaces carry indicia designating the latter spaces as action spaces, and a group of action cards being available to the players for use when a player reaches an action space, said action cards providing a further chance means for determining further movements to be made by a player.

3. The combination of claim 2 and wherein some of said spaces are clear spaces where a player dwells without any further action while his personal marker remains on such a clear space until the next turn of a given player.

4. The combination of claim 3 and wherein the central space which is surrounded by said inner ring of spaces has a marking designating said central space as a special space giving a player reaching said central space a special advantage.

* * * * *